US007266983B2

(12) United States Patent
Krueger et al.

(10) Patent No.: US 7,266,983 B2
(45) Date of Patent: Sep. 11, 2007

(54) METHODS TO DETECT FORMATION PRESSURE

(75) Inventors: Sven Krueger, Celle (DE); Eick Niemeyer, Hanover (DE); Matthias Meister, Celle (DE); Jaedong Lee, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/195,310

(22) Filed: Aug. 2, 2005

(65) Prior Publication Data

US 2006/0016594 A1 Jan. 26, 2006

Related U.S. Application Data

(63) Continuation-in-part of application No. 10/242,184, filed on Sep. 12, 2002, now Pat. No. 6,923,052.

(51) Int. Cl.
*E21B 21/08* (2006.01)

(52) U.S. Cl. ..... 72/152.22

(58) Field of Classification Search ..... 73/152.21, 73/152.22, 152.23, 152.2, 152.51, 152.52, 73/152.27; 166/250.1, 264
See application file for complete search history.

(56) References Cited

U.S. PATENT DOCUMENTS

| | | | | |
|---|---|---|---|---|
| 5,233,866 | A | 8/1993 | Desbrandes | 76/155 |
| 5,377,755 | A | 1/1995 | Michaels et al. | 166/264 |
| 5,602,334 | A | 2/1997 | Proett et al. | 73/152.05 |
| 5,708,204 | A | 1/1998 | Kasap | 73/152.52 |
| 5,803,186 | A | 9/1998 | Berger et al. | 175/50 |
| 5,959,203 | A | 9/1999 | Ajjoul | 73/152.51 |
| 2002/0060094 | A1 | 5/2002 | Meister et al. | 175/50 |
| 2004/0045706 | A1 | 3/2004 | Pop et al. | 166/250.07 |
| 2004/0111216 | A1 | 6/2004 | Kneissl et al. | 702/12 |
| 2005/0039527 | A1* | 2/2005 | Dhruva et al. | 73/152.27 |

OTHER PUBLICATIONS

Robust And Simple Graphical Solution For Wireline Formation Tests: Combined Drawdown And Buildup Analyses, Kasap et al., Society of Petroleum Engineers, 1996, SPE 36525, pp. 343-357.
Enhanced Wireline Formation Tests In Low-Permeability Formations: Quality Control Through Formation Rate Analysis, Lee et al., Society of Petroleum Engineers, 2000, SPE 60293, pp. 1-7.
Nonlinear Regression The Information Content of Pressure, Sep. 30, 2001, Onur, M. et al. SPE 71579.

* cited by examiner

*Primary Examiner*—Hezron Williams
*Assistant Examiner*—Tamiko Bellamy
(74) *Attorney, Agent, or Firm*—Madan, Mossman & Sriram, P.C.

(57) ABSTRACT

A method of determining a formation pressure during drawdown of a formation comprises sampling fluid from a formation using a downhole tool. A fluid sample pressure is determined at two different times during the drawdown. The fluid sample pressures are analyzed using a higher-order pressure derivative with respect to time technique to determine the formation pressure during the drawdown. Another method of determining a formation pressure during drawdown of a formation comprises sampling fluid from a formation using a downhole tool. A fluid sample pressure is determined at two different times during the drawdown. The fluid sample pressures are analyzed using at least two analysis techniques to each determine an estimate of the formation pressure during the drawdown.

23 Claims, 11 Drawing Sheets

METHODS TO DETECT FORMATION PRESSURE

CROSS REFERENCES TO RELATED APPLICATIONS

This application is a Continuation-In-Part of U.S. patent application Ser. No. 10/242,184 filed on Sep. 12, 2002, and issued as U.S. Pat. No. 6,923,052, on Aug. 2, 2005, which is incorporated herein by reference.

BACKGROUND OF THE INVENTION

1. Field of the Invention

This invention relates to the testing of underground formations or reservoirs. More particularly, this invention relates to methods for sampling and testing a formation fluid.

2. Description of the Related Art

To obtain hydrocarbons such as oil and gas, boreholes are drilled by rotating a drill bit attached at a drill string end. A large proportion of the current drilling activity involves directional drilling, i.e., drilling deviated and horizontal boreholes to increase the hydrocarbon production and/or to withdraw additional hydrocarbons from the earth's formations. Modern directional drilling systems generally employ a drill string having a bottomhole assembly (BHA) and a drill bit at an end thereof that is rotated by a drill motor (mud motor) and/or by rotating the drill string. A number of downhole devices placed in close proximity to the drill bit measure certain downhole operating parameters associated with the drill string. Such devices typically include sensors for measuring downhole temperature and pressure, azimuth and inclination measuring devices and a resistivity-measuring device to determine the presence of hydrocarbons and water. Additional down-hole instruments, known as logging-while-drilling (LWD) tools, are frequently attached to the drill string to determine the formation geology and formation fluid conditions during the drilling operations.

Drilling fluid (commonly known as the "mud" or "drilling mud") is pumped into the drill pipe to rotate the drill motor, provide lubrication to various members of the drill string including the drill bit and to remove cuttings produced by the drill bit. The drill pipe is rotated by a prime mover, such as a motor, to facilitate directional drilling and to drill vertical boreholes. The drill bit is typically coupled to a bearing assembly having a drive shaft, which in turn rotates the drill bit attached thereto. Radial and axial bearings in the bearing assembly provide support to the radial and axial forces of the drill bit.

Boreholes are usually drilled along predetermined paths and the drilling of a typical borehole proceeds through various formations. The drilling operator typically controls the surface-controlled drilling parameters, such as the weight on bit, drilling fluid flow through the drill pipe, the drill string rotational speed and the density and viscosity of the drilling fluid to optimize the drilling operations. The downhole operating conditions continually change and the operator must react to such changes and adjust the surface-controlled parameters to optimize the drilling operations. For drilling a borehole in a virgin region, the operator typically has seismic survey plots which provide a macro picture of the subsurface formations and a pre-planned borehole path. For drilling multiple boreholes in the same formation, the operator also has information about the previously drilled boreholes in the same formation.

Typically, the information provided to the operator during drilling includes borehole pressure and temperature and drilling parameters, such as Weight-On-Bit (WOB), rotational speed of the drill bit and/or the drill string, and the drilling fluid flow rate. In some cases, the drilling operator also is provided selected information about the bottom hole assembly condition (parameters), such as torque, mud motor differential pressure, torque, bit bounce and whirl etc.

Downhole sensor data are typically processed downhole to some extent and telemetered uphole by sending a signal through the drill string, or by mud-pulse telemetry which is transmitting pressure pulses through the circulating drilling fluid. Although mud-pulse telemetry is more commonly used, such a system is capable of transmitting only a few (1-4) bits of information per second. Due to such a low transmission rate, the trend in the industry has been to attempt to process greater amounts of data downhole and transmit selected computed results or "answers" uphole for use by the driller for controlling the drilling operations.

Commercial development of hydrocarbon fields requires significant amounts of capital. Before field development begins, operators desire to have as much data as possible in order to evaluate the reservoir for commercial viability. Despite the advances in data acquisition during drilling using the MWD systems, it is often necessary to conduct further testing of the hydrocarbon reservoirs in order to obtain additional data. Therefore, after the well has been drilled, the hydrocarbon zones are often tested with other test equipment.

One type of post-drilling test involves producing fluid from the reservoir, shutting-in the well, collecting samples with a probe or dual packers, reducing pressure in a test volume and allowing the pressure to build-up to a static level. This sequence may be repeated several times at several different depths or point within a single reservoir and/or at several different reservoirs within a given borehole. One of the important aspects of the data collected during such a test is the pressure build-up information gathered after drawing the pressure down. From these data, information can be derived as to permeability, and size of the reservoir. Further, actual samples of the reservoir fluid must be obtained, and these samples must be tested to gather Pressure-Volume-Temperature data and fluid properties such as density, viscosity and composition.

In order to perform these important tests, some systems require retrieval of the drill string from the borehole. Thereafter, a different tool, designed for the testing, is run into the borehole. A wireline is often used to lower the test tool into the borehole. The test tool sometimes utilizes packers for isolating the reservoir. Numerous communication devices have been designed which provide for manipulation of the test assembly, or alternatively, provide for data transmission from the test assembly. Some of those designs include mud-pulse telemetry to or from a downhole microprocessor located within, or associated with the test assembly. Alternatively, a wire line can be lowered from the surface, into a landing receptacle located within a test assembly, establishing electrical signal communication between the surface and the test assembly. Regardless of the type of test equipment currently used, and regardless of the type of communication system used, the amount of time and money required for retrieving the drill string and running a second test rig into the hole is significant. Further, if the hole is highly deviated, a wire line can not be used to perform the testing, because the test tool may not enter the hole deep enough to reach the desired formation.

A more recent system is disclosed in U.S. Pat. No. 5,803,186 to Berger et al. The '186 patent provides a MWD system that includes use of pressure and resistivity sensors with the MWD system, to allow for real time data transmission of those measurements. The '186 device allows obtaining static pressures, pressure build-ups, and pressure draw-downs with the work string, such as a drill string, in place. Also, computation of permeability and other reservoir parameters based on the pressure measurements can be accomplished without pulling the drill string.

The system described in the '186 patent decreases the time required to take a test when compared to using a wireline. However, the '186 patent does not provide an apparatus for improved efficiency when wireline applications are desirable. A pressure gradient test is one such test wherein multiple pressure tests are taken as a wireline conveys a test apparatus downward through a borehole. The purpose of the test is to determine fluid density in-situ and the interface or contact points between gas, oil and water when these fluids are present in a single reservoir.

A drawback of the '186 patent, as well as other systems requiring fluid intake, is that system clogging caused by debris in the fluid can seriously impede drilling operations. When drawing fluid into the system, cuttings from the drill bit or other rocks being carried by the fluid may enter the system. The '186 patent discloses a series of conduit paths and valves through which the fluid must travel. It is possible for debris to clog the system at any valve location, at a conduit bend or at any location where conduit size changes. If the system is clogged, it may have to be retrieved from the borehole for cleaning causing enormous delay in the drilling operation. Therefore, it is desirable to have an apparatus with reduced risk of clogging to increase drilling efficiency.

Another apparatus and method for measuring formation pressure and permeability is described in U.S. Pat. No. 5,233,866 issued to Robert Desbrandes, hereinafter the '866 patent. FIG. 1 is a reproduction of a figure from the '866 patent that shows a drawdown test method for determining formation pressure and permeability.

Referring to FIG. 1, the method includes reducing pressure in a flow line that is in fluid communication with a borehole wall. In Step 2, a piston is used to increase the flow line volume thereby decreasing the flow line pressure. In other tools, such as that described by Michaels et al in U.S. Pat. No. 5,377,755, incorporated herein by reference, a pump is used to draw fluid from the formation. The rate of pressure decrease is such that formation fluid entering the flow line combines with fluid leaving the flow line to create a substantially linear pressure decrease. A "best straight line fit" is used to define a straight-line reference for a predetermined acceptable deviation determination. The acceptable deviation 40 shown is $2\sigma$ from the straight line. The $2\sigma$ interval is fixed and can not be adapted to in-situ downhole conditions. Once the straight-line reference is determined, the volume increase is maintained at a steady rate. At a time $t_1$, the pressure exceeds the $2\sigma$ limit and it is assumed that the flow line pressure being below the formation pressure causes the deviation. At $t_1$, the drawdown is discontinued and the pressure is allowed to stabilize in Step 3. At $t_2$, another drawdown cycle is started which may include using a new straight-line reference. The drawdown cycle is repeated until the flow line stabilizes at a pressure twice. Step 5 starts at $t_4$ and shows a final drawdown cycle for determining permeability of the formation. Step 5 ends at $t_5$ when the flow line pressure builds up to the borehole pressure Pm. With the flow line pressure equalized to the borehole pressure, the chance of sticking the tool is reduced. The tool can then be moved to a new test location or removed from the borehole.

A drawback of the '866 patent is that the time required for testing is too long due to stabilization time during the "mini-buildup cycles." In the case of a low permeability formation, the stabilization may take from tens of minutes to even days before stabilization occurs. One or more cycles following the first cycle only compound the time problem. Another drawback is the fixed statistical interval of 2□ as in some cases it may be necessary to enlarge or minimize the interval depending on the formation parameter.

Whether using wireline or MWD, the formation pressure and permeability measurement systems discussed above measure pressure by drawing down the pressure of a portion of the borehole to a point below the expected formation pressure in one step to a predetermined point well below the expected formation pressure or continuing the drawdown at an established rate until the formation fluid entering the tool stabilizes the tool pressure. Then the pressure is allowed to rise and stabilize by stopping the drawdown. The drawdown cycle may be repeated to ensure a valid formation pressure is being measured, and in some cases lost or corrupted data require retest. This is a time-consuming measurement process.

One method for measuring permeability and other parameters of a formation and fluid from such data is described in U.S. Pat. No. 5,708,204 issued to Ekrem Kasap, and assigned to Western Atlas, hereinafter the '204 patent and incorporated herein by reference. The '204 patent describes a fluid flow rate analysis method for wireline formation testing tools, from which near-wellbore permeability, formation pressure (p*), and formation fluid compressibility are readily determined. When a formation rate analysis is performed using a piston to draw formation fluid, both pressure and piston displacement measurements as a function of time are analyzed. Both the drawdown and buildup cycles are used to determine formation properties.

The existing tools typically withdraw a fluid sample at a predetermined drawdown rate without prior knowledge of the formation permeability or the formation pressure, p*. In many cases, the draw down rate is too fast for the permeability of the formation. This may result in large drawdown differential pressure between the formation tester and the formation. In the low-permeability formations, this may result in excessive buildup time. The excessive buildup time may cause the test to be abandoned and retried costing valuable rig time.

It would be highly desirable to have a method of detecting the formation pressure during the first drawdown (initial test) to speed up the overall test sequence. By detecting the formation pressure during the drawdown, the test sequence may be adapted to more efficiently determine other formation parameters.

SUMMARY OF THE INVENTION

The present invention addresses the problems of the prior art by providing multiple techniques for estimating formation pressure from data taken during the drawdown cycle.

In one aspect, the present invention provides a method of determining a formation pressure during drawdown of a formation comprises sampling fluid from a formation using a downhole tool. A fluid sample pressure is determined at two different times during the drawdown. The fluid sample pressures are analyzed using a higher-order pressure derivative with respect to time technique to determine the formation pressure during the drawdown.

In another aspect, a method of determining a formation pressure during drawdown of a formation comprises sampling fluid from a formation using a downhole tool. A fluid sample pressure is determined at two different times during the drawdown. The fluid sample pressures are analyzed using at least two analysis techniques to each determine an estimate of the formation pressure during the drawdown, wherein the at least two analysis techniques are drawn from the group consisting of; a first pressure derivative technique; a higher-order pressure derivative technique; a formation rate analysis technique; a dp/dt-ratio technique; and a stepwise drawdown technique.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DESCRIPTION OF PREFERRED EMBODIMENTS

Figure 2:
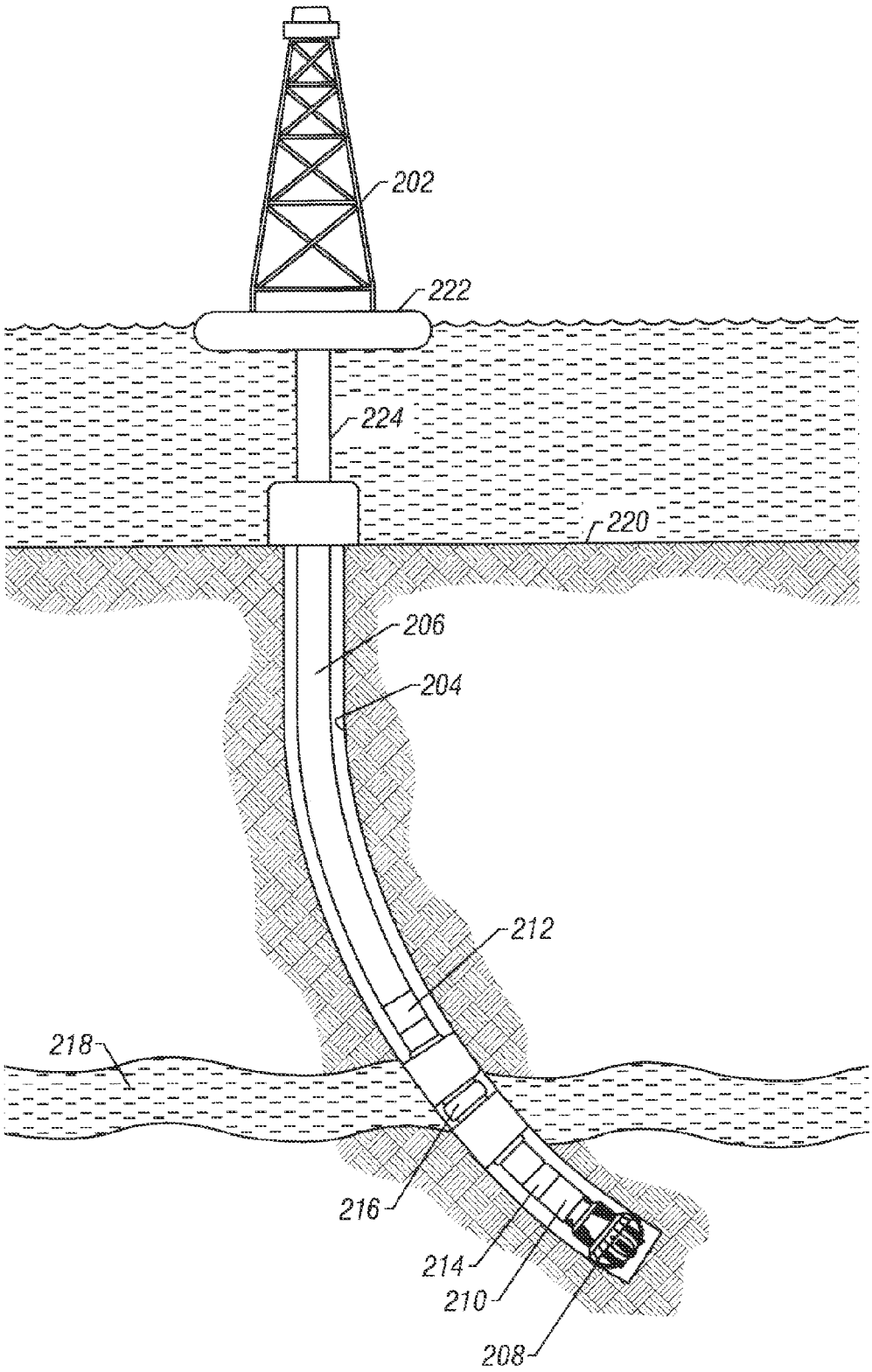
FIG. 2 is an elevation view of an offshore drilling system according to one embodiment of the present invention.

FIG. 2 is a drilling apparatus according to one embodiment of the present invention. A typical drilling rig 202 with a borehole 204 extending therefrom is illustrated, as is well understood by those of ordinary skill in the art. The drilling rig 202 has a work string 206, which in the embodiment shown is a drill string. The drill string 206 has attached thereto a drill bit 208 for drilling the borehole 204. The present invention is also useful in other types of work strings, and it is useful with a wireline, jointed tubing, coiled tubing, or other small diameter work string such as snubbing pipe. The drilling rig 202 is shown positioned on a drilling ship 222 with a riser 224 extending from the drilling ship 222 to the sea floor 220. However, any drilling rig configuration such as a land-based rig may be adapted to implement the present invention.

If applicable, the drill string 206 can have a downhole drill motor 210. Incorporated in the drill string 206 above the drill bit 208 is a typical testing unit, which can have at least one sensor 214 to sense downhole characteristics of the borehole, the bit, and the reservoir, with such sensors being well known in the art. A useful application of the sensor 214 is to determine direction, azimuth and orientation of the drill string 206 using an accelerometer or similar sensor. The BHA also contains the formation test apparatus 216 of the present invention, which will be described in greater detail hereinafter. A telemetry system 212 is located in a suitable location on the work string 206 such as above the test apparatus 216. The telemetry system 212 is used for command and data communication between the surface and the test apparatus 216.

Figure 3:
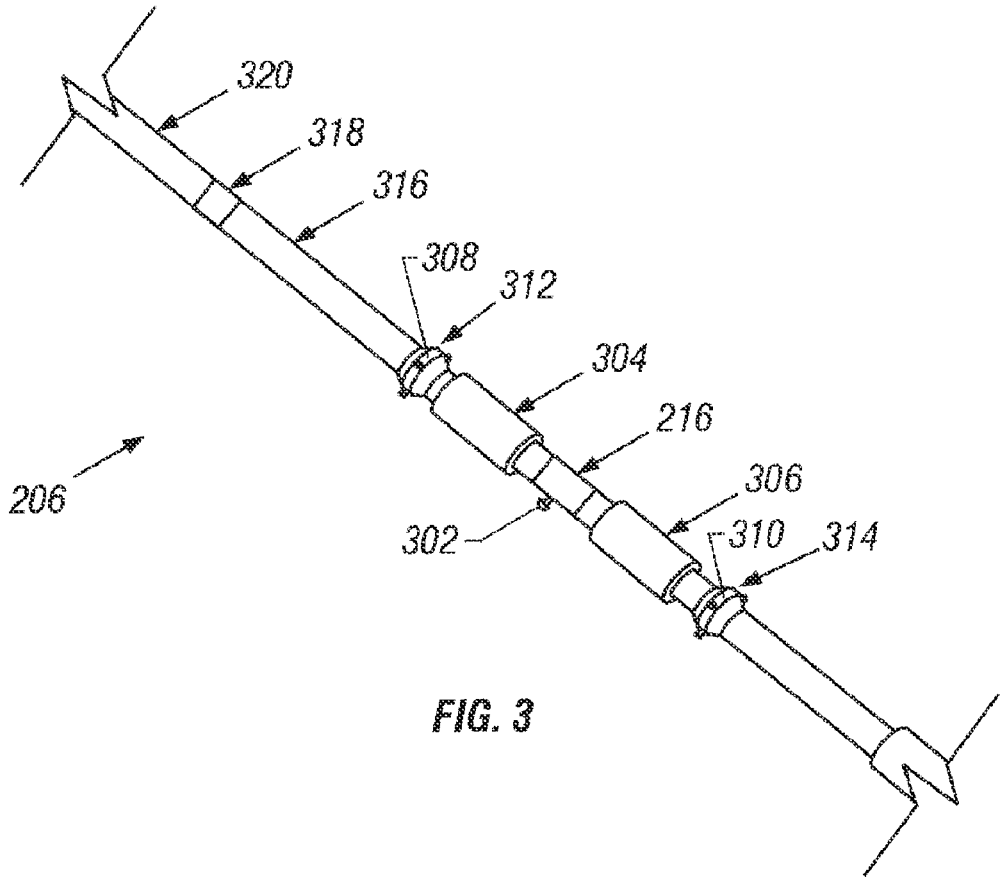
FIG. 3 shows a portion of drill string incorporating the present invention.

FIG. 3 is a section of drill string 206 incorporating the present invention. The tool section is preferably located in a BHA close to the drill bit (not shown). The tool includes a communication unit and power supply 320 for two-way communication to the surface and supplying power to the downhole components. In one preferred embodiment, the tool requires a signal from the surface only for test initiation. A downhole controller and processor (not shown) carry out all subsequent control. The power supply may be a generator driven by a mud motor (not shown) or it may be any other suitable power source. Also included are multiple stabilizers 308 and 310 for stabilizing the tool section of the drill string 206 and packers 304 and 306 for sealing a portion of the annulus. A circulation valve disposed preferably above the upper packer 304 is used to allow continued circulation of drilling mud above the packers 304 and 306 while rotation of the drill bit is stopped. A separate vent or equalization valve (not shown) is used to vent fluid from the test volume between the packers 304 and 306 to the upper annulus. This venting reduces the test volume pressure, which is required for a drawdown test. It is also contemplated that the pressure between the packers 304 and 306 could be reduced by drawing fluid into the system or venting fluid to the lower annulus, but in any case some method of increasing the volume of the intermediate annulus to decrease the pressure will be required.

Figure 1:
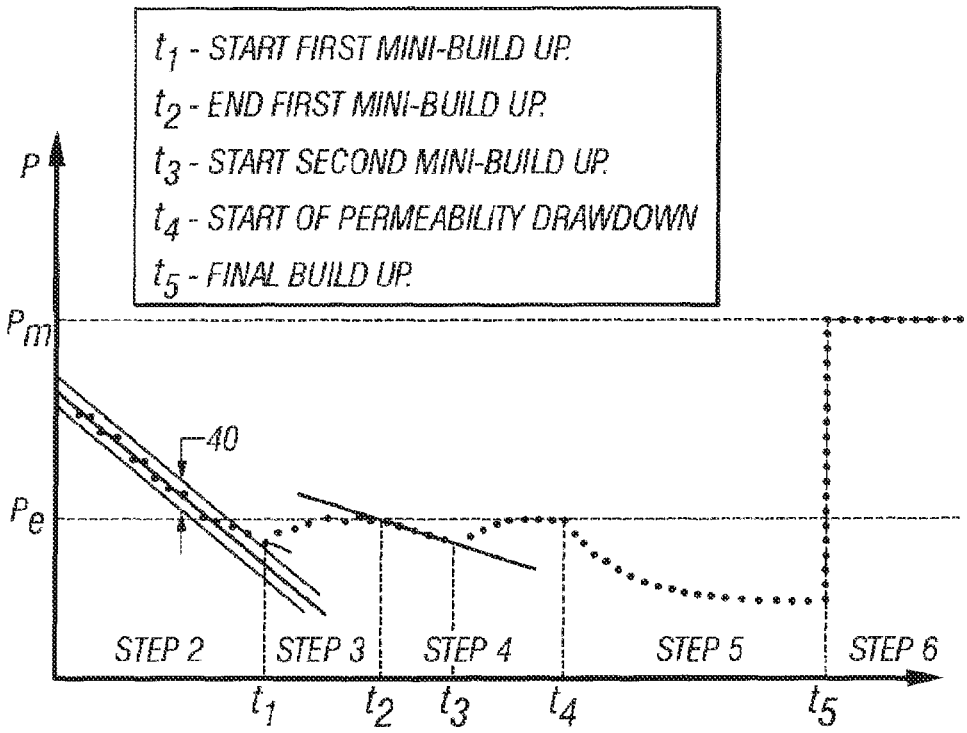
FIG. 1 (Prior Art)
FIG. 1 is a graphical qualitative representation a formation pressure test using a particular prior art method.

In one embodiment of the present invention an extendable pad-sealing element 302 for engaging the well wall 4 (FIG. 1) is disposed between the packers 304 and 306 on the test apparatus 216. The pad-sealing element 302 could be used without the packers 304 and 306, because a sufficient seal with the well wall can be maintained with the pad 302 alone. If packers 304 and 306 are not used, a counterforce is required so pad 302 can maintain sealing engagement with the wall of the borehole 204. The seal creates a test volume at the pad seal and extending only within the tool to the pump rather than also using the volume between packer elements.

One way to ensure the seal is maintained is to ensure greater stability of the drill string 206. Selectively extendable gripper elements 312 and 314 could be incorporated into the drill string 206 to anchor the drill string 206 during the test. The grippers 312 and 314 are shown incorporated into the stabilizers 308 and 310 in this embodiment. The grippers 312 and 314, which would have a roughened end surface for engaging the well wall, would protect soft components such as the pad-sealing element 302 and packers 304 and 306 from damage due to tool movement. The grippers 312 would be especially desirable in offshore systems such as the one shown in FIG. 2, because movement caused by heave can cause premature wear out of sealing components.

Figure 4:
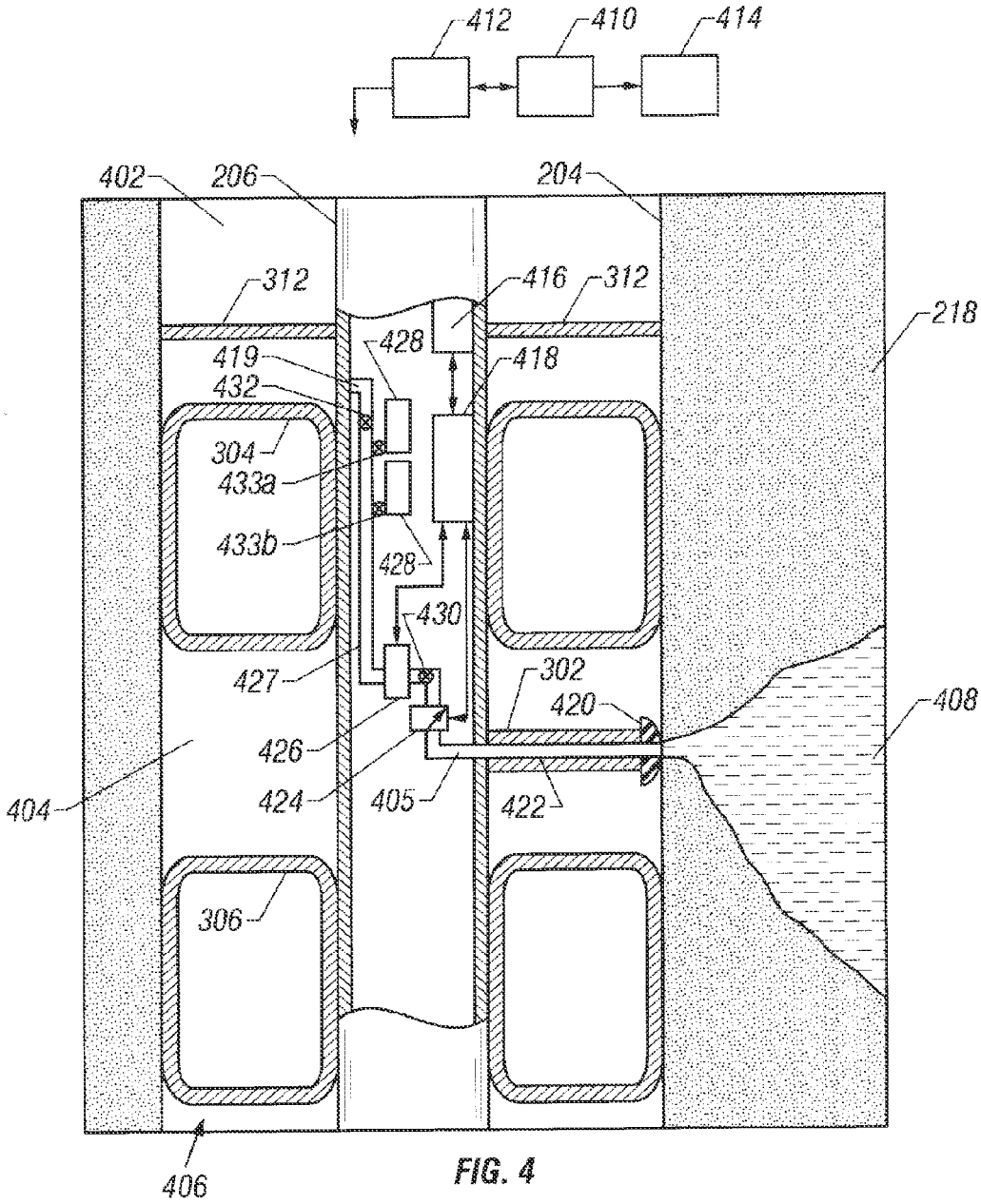
FIG. 4 is a system schematic of the present invention.

FIG. 4 shows the tool of FIG. 3 schematically with internal downhole and surface components. Selectively extendable gripper elements 312 engage the borehole wall 204 to anchor the drill string 206. Packer elements 304 and 306 well known in the art extend to engage the borehole wall 204. The extended packers separate the well annulus into three sections, an upper annulus 402, an intermediate annulus 404 and a lower annulus 406. The sealed annular section (or simply sealed section) 404 is adjacent a formation 218. Mounted on the drill string 206 and extendable into the sealed section 404 is the selectively extendable pad sealing element 302. A fluid line providing fluid communication between pristine formation fluid 408 and tool sensors such as pressure sensor 424 is shown extending through the pad member 302 to provide a port 420 in the sealed annulus 404. The preferable configuration to ensure pristine fluid is tested or sampled is to have packers 304 and 306 sealingly urged against the wall 204, and to have a sealed relationship between the wall and extendable element 302. Reducing the pressure in sealed section 404 prior to engaging the pad 302 will initiate fluid flow from the formation into the sealed section 404. With formation flowing when the extendable element 302 engages the wall, the port 420 extending through the pad 320 will be exposed to pristine fluid 408. Control of the orientation of the extendable element 302 is highly desirable when drilling deviated or horizontal wells. The preferred orientation is toward an upper portion of the borehole wall. A sensor 214, such as an accelerometer, can be used to sense the orientation of the extendable element 302. The extendable element can then be oriented to the desired direction using methods and not-shown components well known in the art such as directional drilling with a bend-sub. For example, the drilling apparatus may include a drill string 206 rotated by a surface rotary drive (not shown). A downhole mud motor (see FIG. 2 at 210) may be used to independently rotate the drill bit. The drill string can thus be rotated until the extendable element is oriented to the desired direction as indicated by the sensor 214. The surface rotary drive is halted to stop rotation of the drill string 206 during a test, while rotation of the drill bit may be continued using the mud motor of desired.

A downhole controller 418 preferably controls the test. The controller 418 is connected to at least one system volume control device (pump) 426. The pump 426 is a preferably small piston driven by a ball screw and stepper motor or other variable control motor, because of the ability to iteratively change the volume of the system. The pump 426 may also be a progressive cavity pump. When using other types of pumps, a flow meter should also be included. A valve 430 for controlling fluid flow to the pump 426 is disposed in the fluid line 422 between a pressure sensor 424 and the pump 426. A test volume 405 is the volume below the retracting piston of the pump 426 and includes the fluid line 422. The pressure sensor is used to sense the pressure within the test volume 404. The sensor 424 is connected to the controller 418 to provide the feedback data required for a closed loop control system. The feedback is used to adjust parameter settings such as a pressure limit for subsequent volume changes. The downhole controller should incorporate a processor (not separately shown) for further reducing test time, and an optional database and storage system could be incorporated to save data for future analysis and for providing default settings.

When drawing down the sealed section 404, fluid is vented to the upper annulus 402 via an equalization valve 419. A conduit 427 connecting the pump 426 to the equalization valve 419 includes a selectable internal valve 432. If fluid sampling is desired, the fluid may be diverted to optional sample reservoirs 428 by using the internal valves 432, 433*a*, and 433*b* rather than venting through the equalization valve 419. For typical fluid sampling, the fluid contained in the reservoirs 428 is retrieved from the well for analysis.

A preferred embodiment for testing low mobility (tight) formations includes at least one pump (not separately shown) in addition to the pump 426 shown. The second pump should have an internal volume much less than the internal volume of the primary pump 426. A suggested volume of the second pump is 1/100 the volume of the primary pump. A typical "T" connector having selection valve controlled by the downhole controller 418 may be used to connect the two pumps to the fluid line 422.

In a tight formation, the primary pump is used for the initial draw down. The controller switches to the second pump for operations below the formation pressure. An advantage of the second pump with a small internal volume is that build-up times are faster than with a pump having a larger volume.

Results of data processed downhole may be sent to the surface in order to provide downhole conditions to a drilling operator or to validate test results. The controller passes processed data to a two-way data communication system 416 disposed downhole. The downhole system 416 transmits a data signal to a surface communication system 412. There are several methods and apparatus known in the art suitable for transmitting data. Any suitable system would suffice for the purposes of this invention. Once the signal is received at the surface, a surface controller and processor 410 converts and transfers the data to a suitable output or storage device 414. As described earlier, the surface controller 410 and surface communication system 412 is also used to send the test initiation command.

Figure 5:
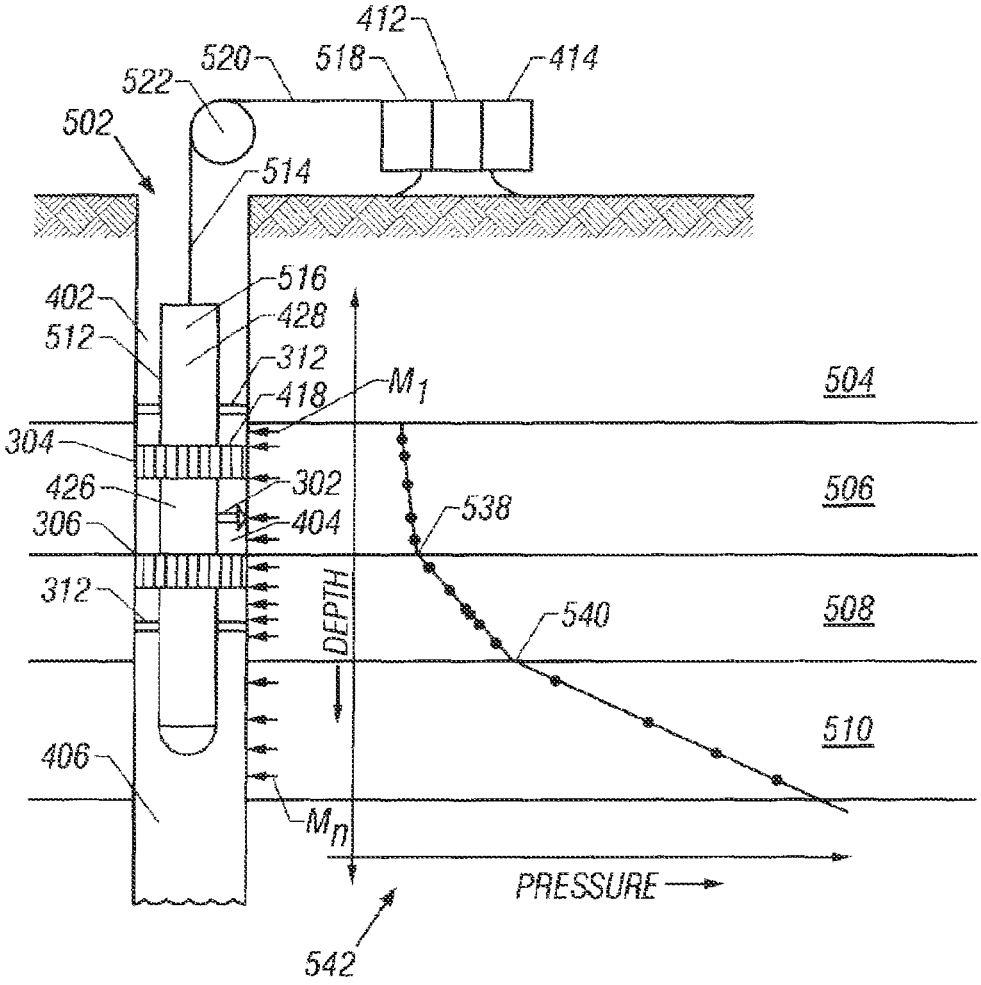
FIG. 5 is an elevation view of a wireline embodiment according to the present invention.

FIG. 5 is a wireline embodiment according to the present invention. A well 502 is shown traversing a formation 504 containing a reservoir having gas 506, oil 508 and water 510 layers. A wireline tool 512 supported by an armored cable 514 is disposed in the well 502 adjacent the formation 504. Extending from the tool 512 are optional grippers 312 for stabilizing the tool 512. Two expandable packers 304 and 306 are disposed on the tool 512 are capable of separating the annulus of the borehole 502 into an upper annulus 402, a sealed intermediate annulus 404 and a lower annulus 406. A selectively extendable pad member 302 is disposed on the tool 512. The grippers 312, packers 304 and 306, and extendable pad element 302 are essentially the same as those described in FIGS. 3 and 4, therefore the detailed descriptions are not repeated here.

Telemetry for the wireline embodiment is a downhole two-way communication unit 516 connected to a surface two-way communication unit 518 by one or more conductors 520 within the armored cable 514. The surface communication unit 518 is housed within a surface controller that includes a processor 412 and output device 414 as described in FIG. 4. A typical cable sheave 522 is used to guide the armored cable 514 into the borehole 502. The tool 512 includes a downhole processor 418 for controlling formation tests in accordance with methods to be described in detail later.

The embodiment shown in FIG. 5 is desirable for determining contact points 538 and 540 between the gas 506 and oil 508 and between the oil 508 and water 510. To illustrate this application a plot 542 of pressure vs. depth is shown superimposed on the formation 504. The downhole tool 512 includes a pump 426, a plurality of sensors 424 and optional sample tanks 428 as described above for the embodiment shown in FIG. 4. These components are used to measure formation pressure at varying depths within the borehole 502. The pressures plotted as shown are indicative of fluid or gas density, which varies distinctly from one fluid to the next. Therefore, having multiple pressure measurements $M_1$-$M_n$ provides data necessary to determine the contact points 538 and 540.

Figure 6:
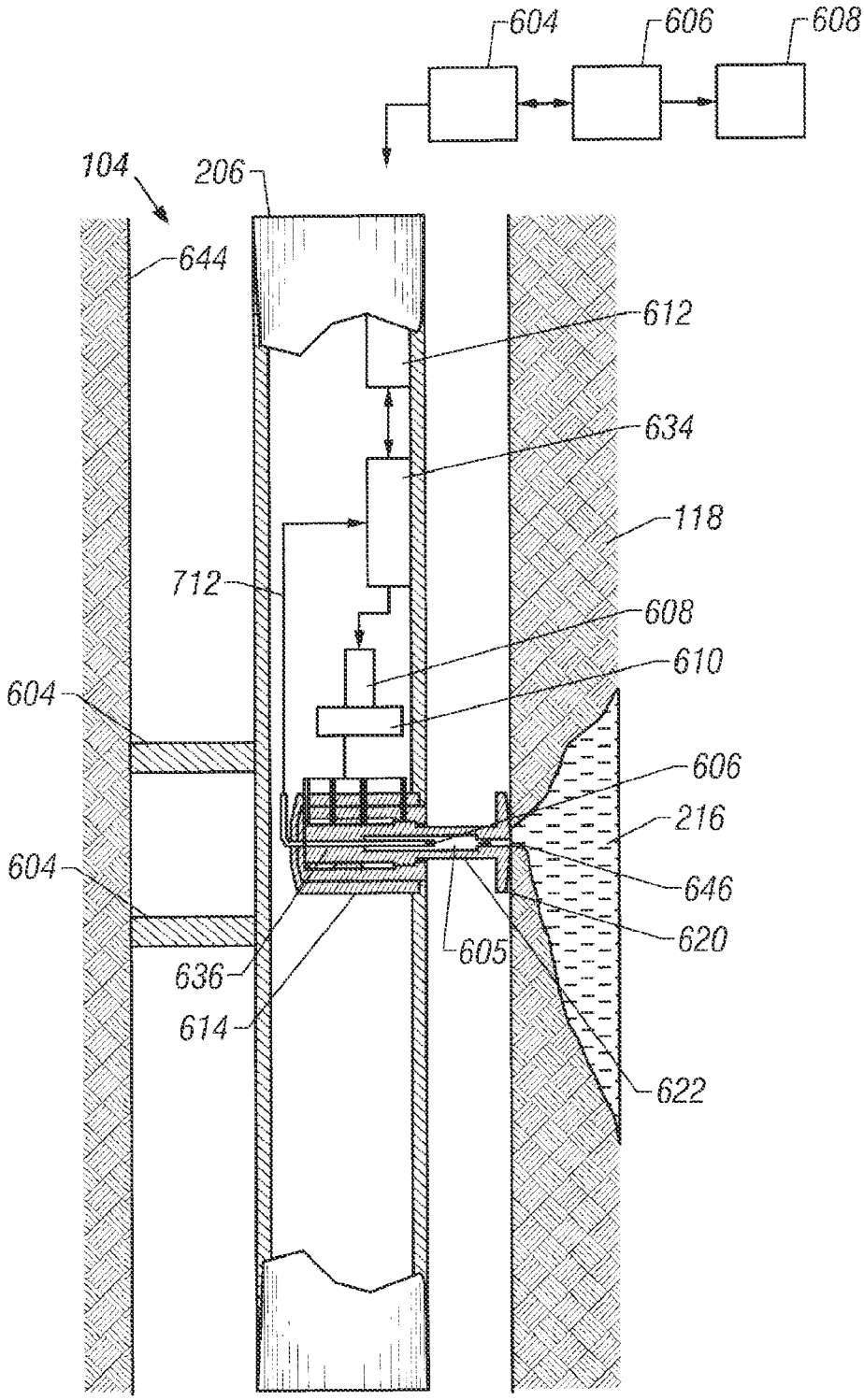
FIG. 6 is a schematic diagram of a fast response tool according to one preferred embodiment of the present invention.

FIG. 6 shows another preferred embodiment of the present invention wherein packers are not required and the optional storage reservoirs are not used, resulting in a small system volume. A drill string 206 carries downhole components comprising a communication/power unit 612, controller 634, pump 608, a valve assembly 610, stabilizers 604, and a piston assembly 614. Piston assembly 614 includes a pad extension piston 622 and a draw down piston 636 arranged in a telescopic fashion. A surface controller sends commands to and receives data from the downhole components. The surface controller comprises a two-way communications unit 654, a processor 656, and an input-output device 658.

In this embodiment, stabilizers or grippers 604 selectively extend to engage the borehole wall 644 to stabilize or anchor the drill string 206 when the piston assembly 614 is adjacent a formation 118 to be tested. A pad extension piston 622 extends in a direction generally opposite the grippers 604. The pad 620 is disposed on the end of the pad extension piston 622 and seals a portion of the annulus 602 at the port 646. Using either a stepper motor or a spindle motor, the selected motor output shaft is connected to a power transmission device such as a ball screw assembly (BSA) to drive the pad and draw down pistons 622 and 636. A BSA uses circulating ball bearings (typically stainless steel or carbon) to roll along complementary helical groves of a nut and screw subassembly. The motor output shaft may turn either the nut or screw while the other translates linearly along the longitudinal axis of the screw subassembly. The translating component is connected to a piston, thus the piston is translated along the longitudinal axis of the screw subassembly axis. A spindle motor is a known electrical motor wherein electrical power is translated into rotary mechanical power. Controlling electrical current flowing through motor windings controls the torque and/or speed of a rotating output shaft. A stepper motor is a known electrical motor that translates electrical pulses into precise discrete mechanical movement. The output shaft movement of a stepper motor can be either rotational or linear. Such a system provides precise control of the pad and draw piston positions. Alternatively, if a controllable pump power source such as a spindle or stepper motor is selected, then the piston 622 position can be selectable throughout the line of travel for providing precise control of system volume.

The configuration of FIG. 6 shows a sensor 606 disposed in the fluid sample reservoir of the piston assembly 614. The sensor senses a desired parameter of interest of the formation fluid such as pressure, and the sensor transmits data indicative of the parameter of interest back to the controller 634 via conductors, fiber optics or other suitable transmission conductor 662. The controller 634 further comprises a controller processor (not separately shown) that processes the data and transmits the results to the surface via the communications and power unit 612. The location of the sensor 606 in the fluid sample reservoir 605 of the piston assembly 614 along with the fast response capability of the motor drive previously described provides the ability to have a quick response control loop for pad and piston position. this quick response control may be used control the sampling of fluid to decrease the sampling time required and to enhance the data quality.

In general, the procedures for taking and analyzing fluid sample pressure data, using such tools, as described herein, include moving the draw down piston backward thereby increasing the sample volume and reducing the pressure in the sample volume. When sample volume pressure, p, falls below formation pressure, p*, and permeability is greater than zero, fluid from the formation starts to flow into the sample volume. When p=p* the flow rate is zero, but gradually increases as p decreases below p*. In actual practice, a finite pressure difference may be required before the wall mud cake starts to slough off the portion of the borehole surface beneath the interior radius of the pad seal. As long as the rate of system-volume-increase (from the piston withdrawal rate) exceeds the rate of fluid flow into the sample volume, pressure in the sample volume will continue to decline. As long as flow from the formation obeys Darcy's law, flow will continue to increase, proportionally to (p*−p). Eventually, flow from the formation becomes equal to the piston rate, and pressure in the sample volume thereafter remains constant. This is known as "steady state" flow. This is detected when the sample volume pressure remains constant at a constant piston rate. As is known in the art, the sample volume pressure asymptotically approaches this value so that the slope of sample volume pressure vs. time becomes zero at "steady state" flow.

The measurement techniques and methods of the present invention are aimed at detecting formation pressure, p*, as soon as possible after the sample volume pressure, p, falls below p*. Multiple analytical techniques are performed on the measured flow and pressure data to detect the formation pressure, p*. These analytical techniques are described below.

dp/dt Technique

Figure 7:
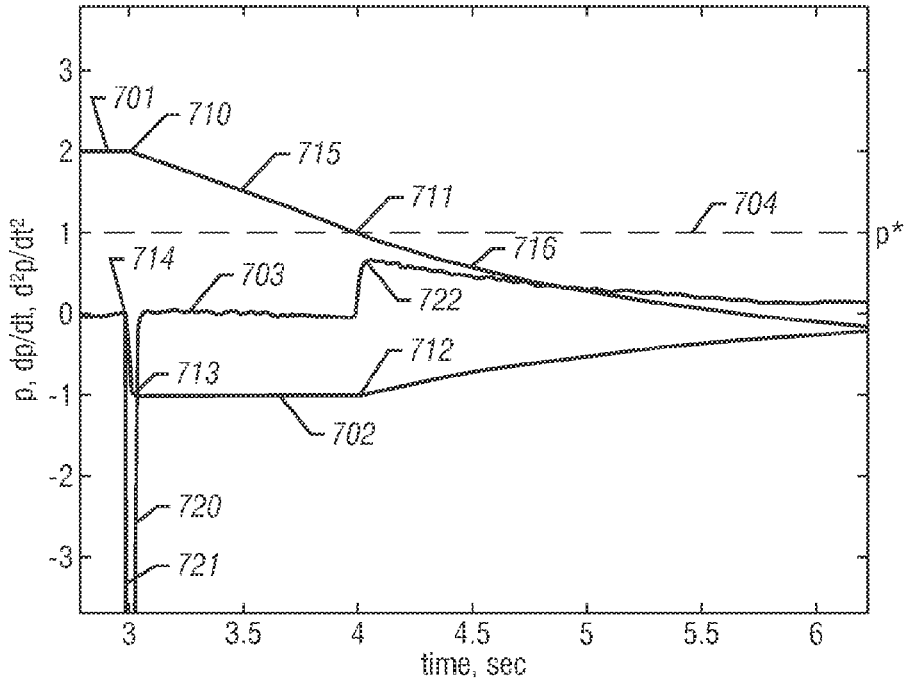
FIG. 7 is a schematic chart showing the use of sample volume pressure derivatives for determining formation pressure according to one preferred embodiment of the present invention.

As previously described, a typical test sequence includes drawing fluid from the formation by using a draw down piston. The piston displacement and the sample volume pressure are measured with respect to time. FIG. 7 shows the typical sample volume pressure 701 plotted with respect to time. The test sequence is started at point 710 with a constant piston draw rate. The pressure decreases at a constant rate, or slope, 715 until the sample pressure passes the formation pressure, 704, also called p*, at 711. Below the formation pressure, the slope 716 continuously changes as formation fluid flows into the sample volume. The pressure curve 701 flattens out as the formation flow rate approaches the sample draw rate. Because the formation flow rate is related to the difference between formation pressure and sample volume pressure, the initial flow rate is small and the change in slope of the pressure-time curve may be undetectable until the sample pressure is significantly below formation pressure. Referring to FIG. 7, the first time derivative, dp/dt, 702 of the pressure-time curve 701 is shown. As can be seen on curve 702, changes in slope of pressure curve 701 are more clearly delineated in dp/dt curve 702. The change in slope 710 of pressure curve 701 is clearly indicated by the change from 714 to 713 on curve 702. During the constant draw down portion 715, the corresponding first derivative curve remains constant. As the slope begins to change as the sample pressure passes formation pressure at 711, the time derivative curve changes at 712. As the slope of the pressure curve continues to change so does the slope of the first derivative curve providing quicker detection of formation pressure p*. For higher mobility formations, the increase in formation flow rate is relatively quick and the first derivative technique provides a quick and clear indication of formation pressure.

In operation, as the drawdown starts, the pressure begins to decrease from a steady value. The pressure is sampled at a predetermined rate. A first derivative, dp/dt, is calculated for each sample value. A local minimum of dp/dt is determined and set as a reference value, $dp/dt_{ref}$. If a successive value of dp/dt is less than the reference value, the successive value is set as a new reference value. Simultaneously, each successive value is compared to determine if the value is greater than the reference value plus a predetermined threshold value. The latter condition indicates the formation pressure as is shown schematically in FIG. 7.

Higher-Order Pressure Derivative Technique

This technique uses higher-order derivatives of pressure with respect to time to indicate formation pressure. As used herein, any of the derivatives of pressure with respect to time higher than the first derivative are considered higher-order derivatives. For example, derivatives of the form, $d^n p/dt^n$, where $n \geqq 2$, are considered higher order derivatives for purposes of this application. In one embodiment, the second time derivative of the pressure-time data for detecting formation pressure, p* is shown, in FIG. 7, wherein curve 720 is the second derivative with respect to time of pressure-time curve 701. Sections of the pressure-time curve with changing slopes, as described above, result in peaks 721, 722 of the second time derivative curve 720. The magnitudes of the peaks 721, 722 are related to how quickly the slope of pressure-time curve changes. Note, in FIG. 7, that a negative peak 721 is associated with a negative change in slope 710 of the pressure-time curve 701. In contrast, a positive change in slope, indicated by the flattening of the pressure-time curve at 716, is indicated by a positive peak 722. The magnitude of peak 722 is related to the mobility of the formation, with a higher mobility resulting in a higher peak. Note that the $d^2p/dt^2$ value 703 between the peaks 721 and 722 are essentially zero because it is the second derivative of a constantly varying signal, as is known in the art. This technique may be implemented by any peak detection algorithm known in the art by looking for a positive going peak after the initiation of the test. If there is noise on the pressure-time data, it will be amplified in the second derivative. The $d^2p/dt^2$ data may be statistically smoothed using a numerical technique, such as a rolling average of a type known in the art. The data is typically smoothed and a 99 percent confidence interval established about the rolling average. When the rolling average of the $d^2p/dt^2$ term exceeds the established confidence interval, in a positive direction, the formation pressure, p*, is indicated.

Figure 10A:
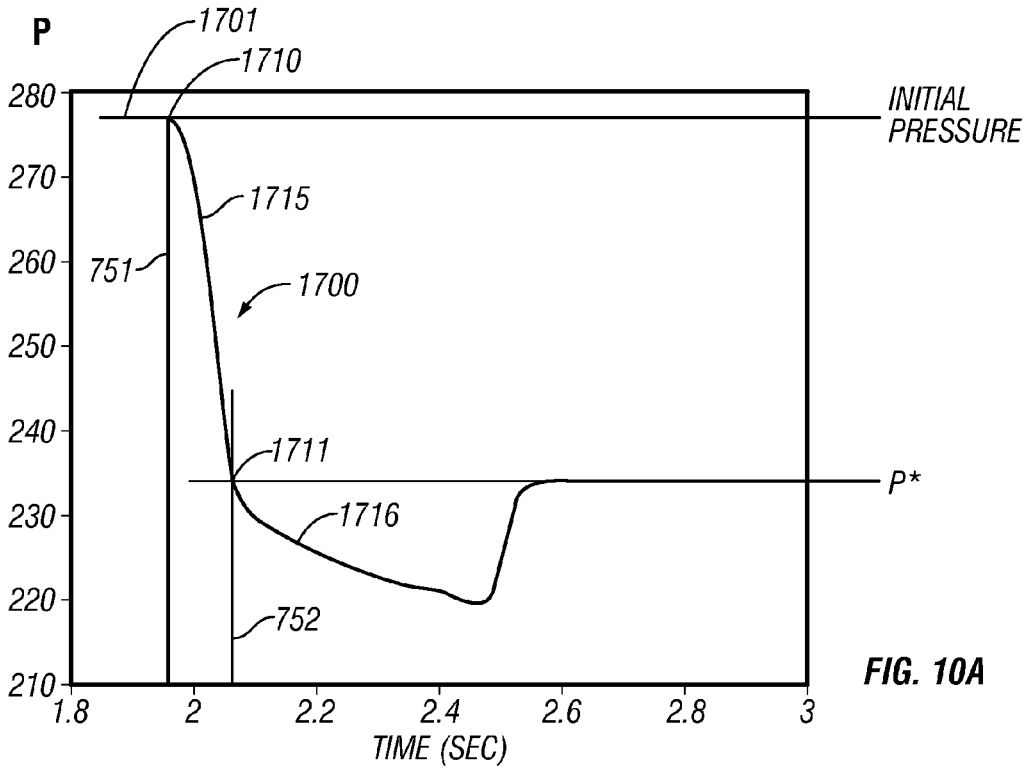
FIG. 10A is a plot showing a fluid sample pressure versus time during an exemplary formation test.
Figure 10B:
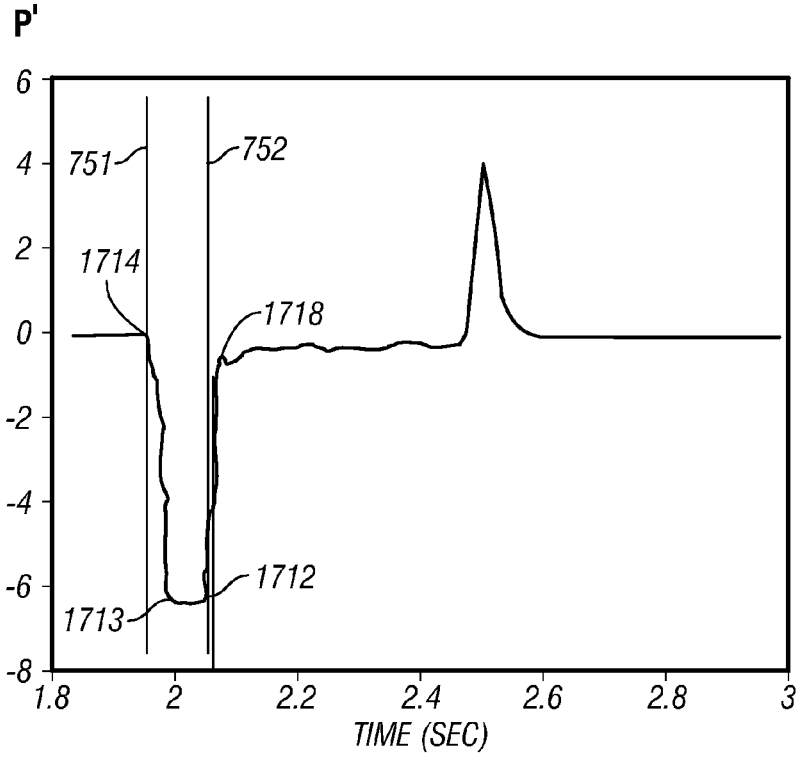
FIG. 10B is a plot of the first pressure derivative with respect to time of the sample pressure of FIG. 10A.
Figure 10C:
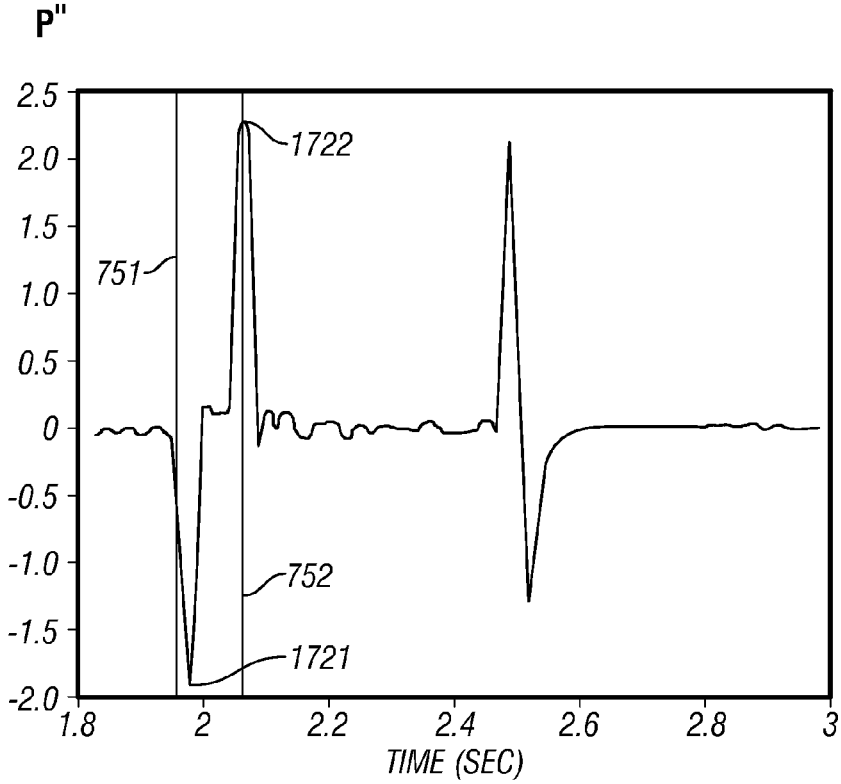
FIG. 10C is a plot of the second pressure derivative with respect to time of the sample pressure of FIG. 10A.

Alternatively, other higher-order derivatives of order greater than the second pressure derivative with respect to time may be employed to indicate changes in the slope of the pressure-time curve. FIGS. 10A-10E illustrate the relationship of pressure time curve 1700 along with the first through fourth derivatives of pressure-time curve 1700 with respect to time. FIGS. 10A-10C illustrate features similar to those shown in FIG. 7. In FIG. 10A, a formation test is initiated at initial bottomhole pressure 1701 by initiating, at 1710, an increase in the sample chamber volume, as described previously. The sample volume increases at a substantially constant rate along section 1715 with a related substantially linear decrease in sample volume pressure. As previously described, as the sample volume pressure decreases past the formation pressure p* at 1711, formation fluid will begin to flow into the sample chamber. This inflow causes the slope of the pressure curve to increase along section 1716. By detecting the point 1711 at which the slope begins to increase, the formation pressure can be identified. However, as one skilled in the art will appreciate, the detection of the slope change from the pressure time curve alone is difficult. Note that event line 751 and 752 are contained in each of FIGS. 10A-10E for ease of relating events in the multiple plots. Event line 751 indicates the initiation of the formation test and event line 752 indicates the point at which the sample pressure is substantially equal to the formation pressure, p*.

As shown in FIGS. 10B and 10C, the first and second derivatives of sample pressure with respect to time provide enhanced detection of the slope change at 1711. The features indicated in FIGS. 10B and 10C are similar to those of FIG. 7. FIG. 10B shows the first time derivative of sample pressure with respect to time. After test initiation 1714, the first derivative curve takes a sharp drop to 1713 reflecting the sharp change in slope of the pressure curve from section 1701 to 1715. During the substantially linear drawdown of 1715, the derivative curve remains substantially constant. As the sample pressure passes below the formation pressure, the change in slope between section 1715 and section 1716 of the pressure curve is reflected by a jump change in the derivative term from 1712 to 1718. It is the detection of the initial sharp drop in the derivative and the subsequent increase that is used to identify the formation pressure, as described previously with respect to FIG. 7.

Similarly, FIG. 10C shows the second time derivative of sample pressure with respect to time, wherein negative peak 1721 indicates the formation test initiation and positive peak 1722 indicates the point at which the sample pressure, p, is substantially equal to formation pressure, p*. Note that in the second derivative curve, the value of the second derivative during the time between peaks is substantially zero such that peak detection schemes known in the art may be used for detecting peaks 1721 and 1722.

Figure 10D:
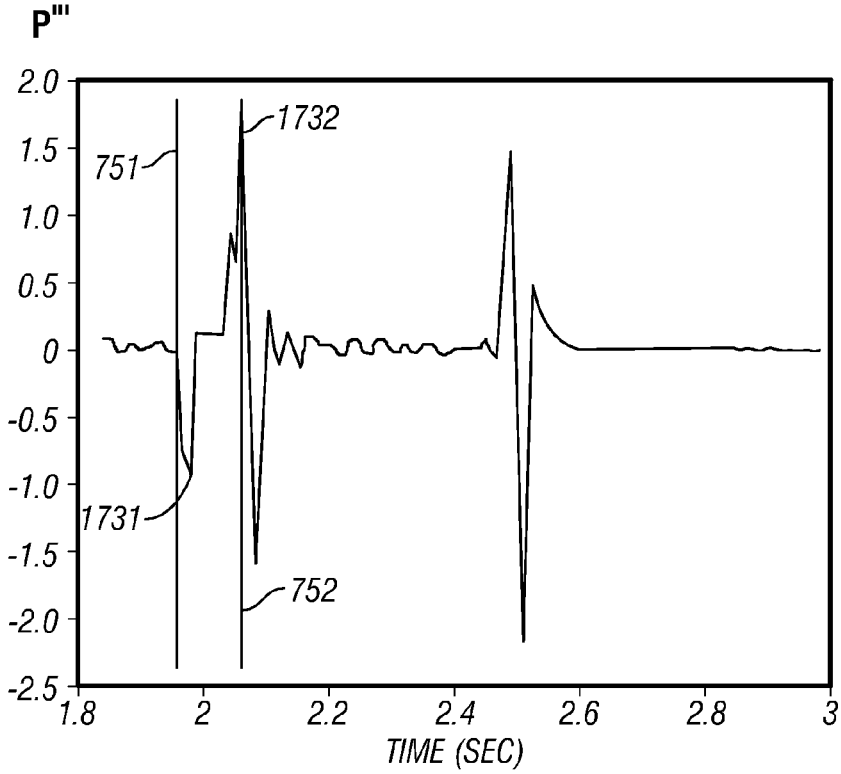
FIG. 10D is a plot of the third pressure derivative with respect to time of the sample pressure of FIG. 10A.
Figure 10E:
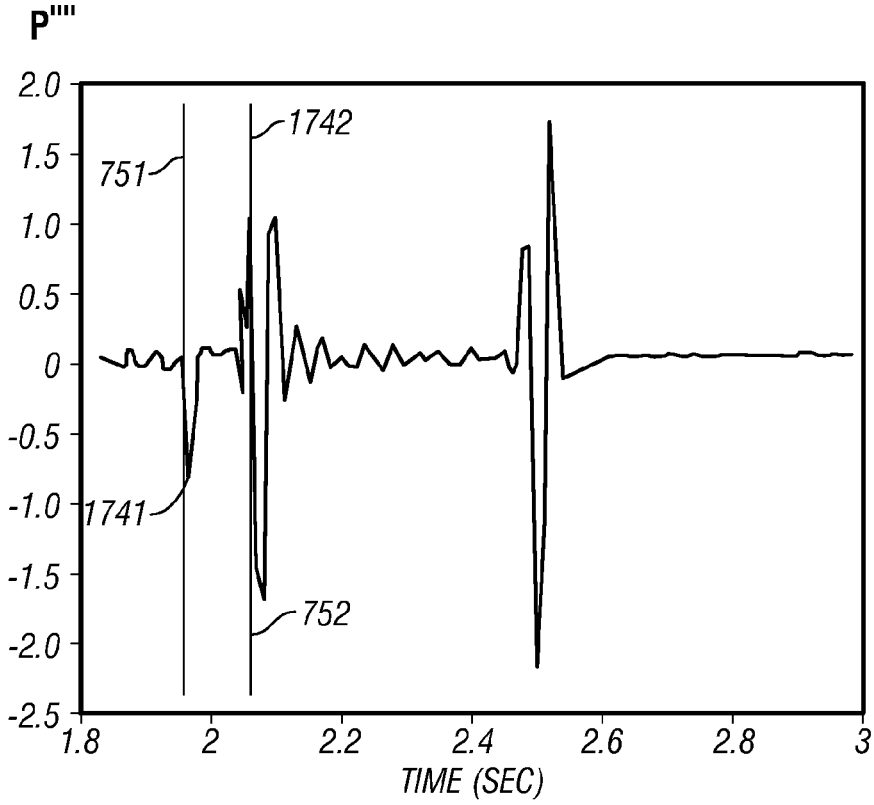
FIG. 10E is a plot of the fourth pressure derivative with respect to time of the sample pressure of FIG. 10A.

FIGS. 10D and 10E show the third and fourth derivatives of sample pressure versus time, respectively. As can be seen in FIGS. 10D and 10E, the nature of these derivatives is substantially similar to that of the second derivative, in that the test initiation produces a negative peak and the crossing of the formation pressure line, and subsequent slope change, causes a positive peak. Peaks 1731 and 1741 indicate the test initiation, and peaks 1732 and 1742 identify the formation pressure, p*, respectively. As such, the implementation of these derivatives is similar to that discussed previously with respect to the second derivative in FIG. 7. As one skilled in the art will appreciate, the nature of the higher-order derivatives is such that any noise on the original signal commonly results in increased noise on the derivative signals, such that additional pre-filtering and/or post-filtering may be required to eliminate false peaks in higher-order derivatives. Any suitable filtering techniques, digital and/or analog, are contemplated to be within the scope of the present invention.

While illustrated herein up to the fourth derivative of pressure with respect to time, it is contemplated that the present invention encompasses all higher order derivatives of pressure with respect to time for determining formation pressure using the techniques described herein.

Formation Rate Analysis Technique

Figure 8:
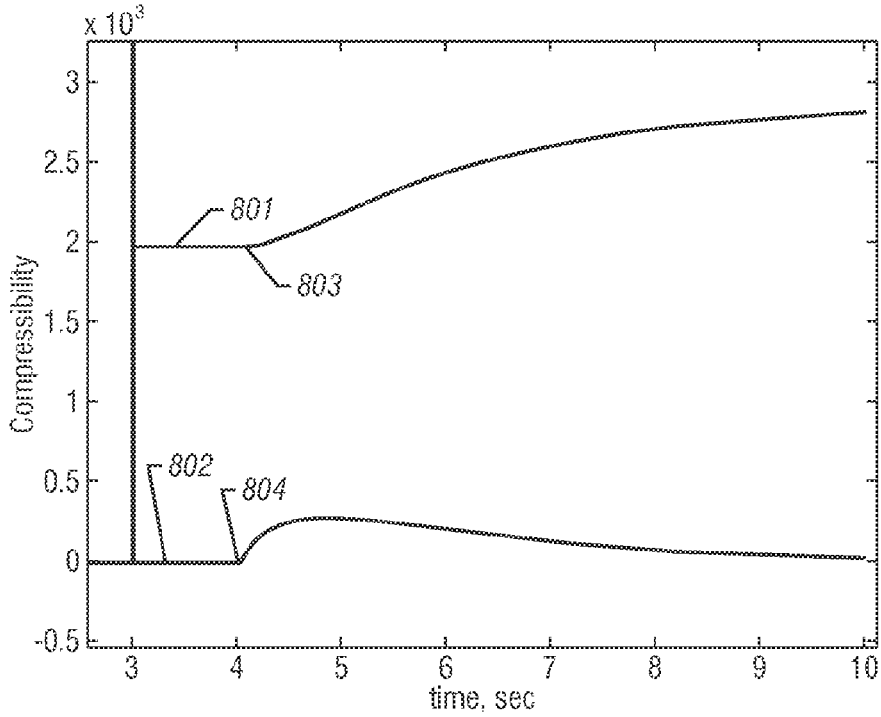
FIG. 8 is a schematic chart showing the use of sample volume compressibility for determining formation pressure according to one preferred embodiment of the present invention.

Formation Rate Analysis (FRA) as described in the '204 patent to Kasap, takes two effects into account: the compressibility of the fluid and the influx from the formation. As shown in the '204 patent, as long as the sample pressure, p, remains above the formation pressure, p*, the FRA equations can be simplified to show that the pressure difference between p and p* is related to the measured change in sample volume and the compressibility, C, of the fluid in the sample chamber. It is clear that C can be calculated using FRA related equations for compressibility of a fluid in a known volume. Such calculations will show a constant fluid compressibility during the draw-down while p>p*. When sample chamber pressure, p, goes below formation pressure, p*, formation fluid enters the sample chamber and the compressibility, C, of the sample chamber fluid changes to reflect the addition of the formation fluid. This change in compressibility is an indication of formation pressure, p*. FIG. 8 shows exemplary results of the FRA technique, plotting values of 1/C 801 and C 802 versus time, calculated using the sample pressure and sample volume measurements as a function of time. Curve 801 remains flat until sample volume pressure falls below formation pressure, then the compressibility of the combined fluid changes and is detectable at 803 indicating formation pressure. The identical indication 804 can be found when monitoring the inverse function C 802.

The dp/dt technique, the $d^2p/dt^2$ technique, and the formation rate technique may be performed simultaneously on the same pressure and drawdown rate data.

dp/dt-Ratio Technique

In contrast to the previous methods, the dp/dt-Ratio technique uses different drawdown rates during the drawdown sequence. As shown in the '204 patent, for sample volume pressure, p, above the formation pressure, p*, the pressure response is related to the draw down rate by;

$$qdd = -CV_{sys}\left(\frac{dp}{dt}\right) \tag{1}$$

where $q_{dd}$ is the drawdown rate, C is the compressibility of the sample volume fluid, $V_{sys}$ is the sample volume, and dp/dt is the first time derivative of the sample pressure. For pressures above the formation pressure, the C and $V_{sys}$ are constant. Therefore, different drawdown rates $qdd_i$ are directly related to corresponding pressure derivatives $(dp/dt)_i$. As long as the pressure, p, is above the formation pressure, p*, the ratio of different drawdown rates and the ratio of the corresponding pressure derivatives are identical. If there is fluid influx from the formation, the ratio of the pressure derivatives is different than the ratio of the of the drawdown rates. When the ratio of the pressure derivatives deviates from the ratio of the drawdown rates by a predetermined threshold level, the formation pressure is indicated.

Stepwise Drawdown Technique

Figure 9:
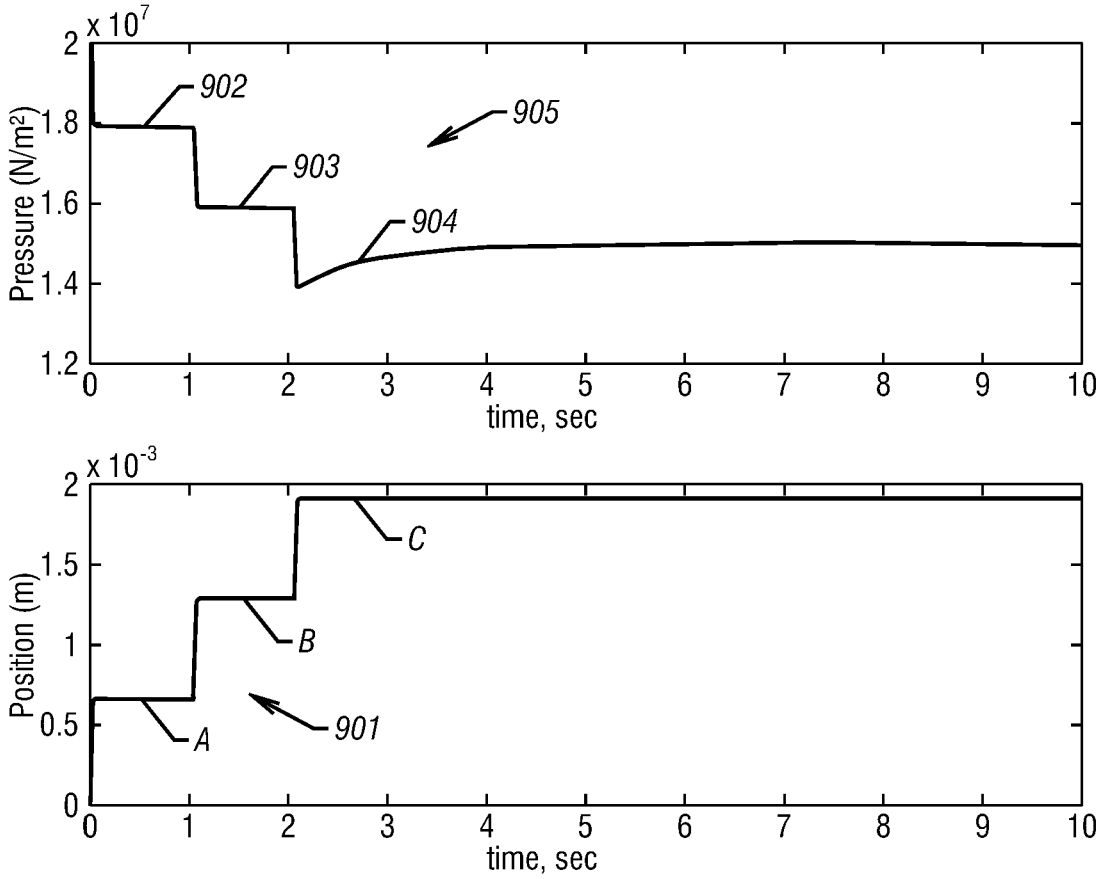
FIG. 9 is a schematic of a stepwise drawdown technique for determining formation pressure according to one preferred embodiment of the present invention.

The Stepwise Drawdown technique performs a stepwise drawdown and analyzes the build-up response to detect formation pressure. The expected maximum overbalance pressure (according to the maximum pressure of the drawdown module) is divided by a predetermined number of drawdown steps to estimate a pressure difference per step, thereby generating a drawdown distance for moving the drawdown piston for each step. During the drawdown the pump is under pressure control until a target pressure is reached. Subsequently, the pump is set under position control. The drawdown piston is moved the predetermined distance for each step with a predetermined dwell time at each step. After each piston movement, the pressure is measured at a predetermined sampling rate and the pressure response is analyzed during the dwell time. Depending on whether the actual pressure is below formation pressure or not, the pressure response will be a build-up or a constant value. The initial pressure, after each piston movement, is established as a reference value. A build-up above the reference value plus a predetermined threshold value is a clear indication that the formation pressure has already been passed, while a constant value leads to the next drawdown step. This is illustrated in FIG. 9, where steps 901A,B,C indicate movement of a drawdown piston in substantially equal draw down steps. The corresponding pressure curve 905 show corresponding constant pressure responses for steps 902 and 903. Step 904, however, shows a build-up pressure response indicating the formation pressure has been passed. The corresponding step reference value is identified as the formation pressure. The resolution of the steps determines the resolution with which the formation pressure may be determined.

Combination of Techniques

The estimated value of formation pressure determined from each of the aforementioned techniques may differ due to the sensitivity of the technique to various properties, such as formation permeability and formation fluid viscosity. The ratio of permeability to viscosity is often referred to as mobility and indicates the ease with which a formation produces fluid at a given pressure difference. For example, a high mobility will exhibit a quick build-up pressure that is easily detected by the dp/dt technique. For low mobilities, the $d^2p/dt^2$ or any other higher-order derivative of pressure with respect to time tends to provide better indications. Algorithms and decision rules may be developed and programmed into the downhole processors of any of the aforementioned tools to compare the multiple values determined by the multiple techniques to provide an improved formation pressure sooner in the formation test than has been previously available. The formation pressure, so determined, may then be used for the remainder of the formation testing sequence. Alternatively, the downhole determined values may be communicated via any of the telemetry schemes described to a surface processor for further processing.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. A method of estimating a formation pressure during drawing of a fluid from a formation, comprising:

drawing the fluid from the formation;

determining a fluid pressure at at least two different times during the drawing of the fluid from the formation; and analyzing the fluid pressures using a higher-order pressure derivative with respect to time to estimate the formation pressure during the drawing of the fluid, wherein the higher-order pressure derivative with respect to time is greater than a second pressure derivative.

2. The method of claim 1, wherein the higher-order pressure derivative with respect to time comprises;

measuring a fluid pressure at a predetermined sample rate;

it calculating a higher-order pressure derivative with respect to time for each successive pressure measurement;

filtering the calculated higher-order pressure derivative with respect to time and establishing a confidence level about a substantially constant higher-order derivative with respect to time;

detecting a first peak from the substantially constant higher-order derivative with respect to time, the first peak having a value less than the substantially constant higher-order derivative with respect to time plus said confidence level and indicative of initiation of a formation test; and detecting a second peak from the substantially constant higher-order derivative with respect to time value, the second peak having a value greater than the substantially constant value plus the confidence level and identifying the corresponding measured pressure as the formation pressure.

3. A method of estimating a formation pressure during drawing of a fluid from a formation, comprising:

sampling fluid from a formation using a downhole tool;

determining a fluid sample pressure at two different times during the drawdown; and analyzing the fluid sample pressures using at least two analysis techniques to each estimate a separate formation pressure during the drawdown, wherein the at least two analysis techniques are drawn from the group consisting of: a first pressure derivative technique; a higher-order pressure derivative technique; a formation rate analysis technique; a dp/dt-ratio technique; and a stepwise drawdown technique.

4. The method of claim 3, wherein each of the separate formation pressure estimates is processed using a set of decision rules to provide the estimate of the formation pressure.

5. The method of claim 1 further comprising measuring each fluid pressure at a selected sample rate.

6. The method of claim 1, wherein drawing the fluid comprises drawing the fluid at a substantially constant flow rate.

7. The method of claim 1, wherein the higher-order pressure derivative with respect to time is one of (i) a third derivative, and (ii) a derivative higher than a third derivative.

8. The method of claim 1 further comprising determining the higher-order pressure derivative with respect to time for successive pressure measurements.

9. The method of claim 8, further comprising:

filtering the higher-order pressure derivative with respect to time; and establishing a confidence level about a substantially constant higher-order pressure derivative with respect to time.

10. The method of claim 9 further comprising: detecting a first peak from the substantially constant higher-order derivative with respect to time, the first peak having a value less than the substantially constant higher-order derivative with respect to time plus the confidence level and indicative of initiation of a formation test.

11. The method of claim 8 further comprising detecting a second peak from the substantially constant higher-order derivative with respect to time value, the second peak having a value greater than the substantially constant value plus the confidence level and identifying the corresponding measured pressure as the formation pressure.

12. The method of claim 1 further comprising controlling drawing of the fluid downhole by one of: a controller deployed downhole; and a controller that sends a command signal to a controller downhole.

13. A method of testing fluid samples downhole, comprising:

lowering a tool in a wellbore, the tool having a device to withdraw the fluid samples from a formation downhole, a pressure sensor for measuring pressure of the withdrawn fluid and a controller for controlling operation of the tool;

drawing fluid samples from a formation downhole;

measuring a fluid pressure at least two different times during the withdrawal of the fluid samples; and analyzing the fluid pressures using a higher-order pressure derivative with respect to time to determine the formation pressure during the withdrawal of the fluid samples, wherein the higher-order pressure derivative is greater than the second pressure derivative.

14. A tool for use in a wellbore, comprising:

a device adapted to drawdown fluid from a formation adjacent a wellbore;

a pressure sensor that measures pressure of the fluid; and a controller that determines fluid pressure at at least two different times during drawing of the fluid and analyzes the fluid pressures using a higher-order pressure derivative with respect to time to estimate the formation pressure wherein the higher-order pressure derivative is greater than the second pressure derivative.

15. The tool of claim 14, wherein the device draws the fluid at a selected flow rate.

16. The tool of claim 15, wherein the device draws the fluid at a substantially constant flow rate.

17. The tool of claim 14, wherein the higher-order pressure derivative with respect to time is one of: (i) a third derivative; and (ii) a derivative higher than a third derivative.

18. The tool of claim 14, wherein the controller further determines the higher-order pressure derivative with respect to time for successive fluid samples.

19. The tool of claim 18, wherein the controller:

filters the higher-order pressure derivative with respect to time and establishes a substantially constant higher-order pressure derivative with respect to time.

20. The tool of claim 19 wherein the controller further detects a first peak from the substantially constant higher-order derivative with respect to time, the first peak having a value less than the substantially constant higher-order derivative with respect to time plus the confidence level and indicative of initiation of a formation test.

21. The tool of claim 20, wherein the controller further detects a second peak from said substantially constant higher-order derivative with respect to time value, the second peak having a value greater than said substantially constant value plus said confidence level and identifying the corresponding measured pressure as the formation pressure.

22. The tool of claim 14, wherein the controller is at least in part positioned at one of: (i) downhole; (ii) a surface location; and (iii) at least in part downhole.

23. The tool of claim 14, wherein the controller controls an operation of the tool in response to a signal received from the surface.

* * * * *